US009592672B2

(12) United States Patent
Chiba et al.

(10) Patent No.: US 9,592,672 B2
(45) Date of Patent: Mar. 14, 2017

(54) LIQUID EJECTING APPARATUS

(71) Applicant: SEIKO EPSON CORPORATION, Tokyo (JP)

(72) Inventors: Satoshi Chiba, Suwa (JP); Kazuhiko Sato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 15 days.

(21) Appl. No.: 14/612,138

(22) Filed: Feb. 2, 2015

(65) Prior Publication Data

US 2015/0217571 A1 Aug. 6, 2015

(30) Foreign Application Priority Data

Feb. 3, 2014 (JP) ..... 2014-018505

(51) Int. Cl.
*B41J 2/165* (2006.01)

(52) U.S. Cl.
CPC ..... *B41J 2/16538* (2013.01); *B41J 2/1652* (2013.01); *B41J 2/16544* (2013.01)

(58) Field of Classification Search
CPC ... B41J 2/1652; B41J 2/16538; B41J 2/16544
See application file for complete search history.

(56) References Cited

U.S. PATENT DOCUMENTS 6,056,387 A * 5/2000 Kaneko ..... 347/23
6,340,218 B1 * 1/2002 Gaylor ..... 347/33
2003/0071872 A1 * 4/2003 Temple ..... 347/33
2004/0207684 A1 * 10/2004 Plymale ..... B41J 2/16538 347/33
2008/0129776 A1 6/2008 Taira
2010/0194801 A1 8/2010 Hibi
2010/0295895 A1 * 11/2010 Tsuji ..... 347/33
2010/0321425 A1 * 12/2010 Kanke et al. ..... 347/6
2011/0193914 A1 * 8/2011 Yamada ..... B41J 2/16526 347/33
2014/0292917 A1 * 10/2014 Ito ..... B41J 2/16538 347/33

FOREIGN PATENT DOCUMENTS

JP 11-286116 10/1999
JP 2006-312261 11/2006
JP 2008-137351 6/2008
JP 2010-179512 8/2010

* cited by examiner

*Primary Examiner* — Kristal Feggins
*Assistant Examiner* — Kendrick Liu
(74) *Attorney, Agent, or Firm* — Workman Nydegger

(57) ABSTRACT

Provided is a liquid ejecting apparatus having a wiping device which performs a first wiping operation in which the first surface wipes the nozzle forming surface while setting a contact pressure of a wiper with respect to the nozzle forming surface to a first contact pressure, in a state where the pressurizing portion is driven and the pressure of liquid in the nozzles is set to be equal to or greater than atmospheric pressure and a second wiping operation in which the second surface wipes the nozzle forming surface wiped by the first surface while setting the contact pressure of the wiper with respect to the nozzle forming surface to a second contact pressure less than the first contact pressure.

5 Claims, 5 Drawing Sheets

LIQUID EJECTING APPARATUS

CROSS-REFERENCE TO RELATED APPLICATIONS

The entire disclosure of Japanese Patent Application No. 2014-018505, filed Feb. 3, 2014, is expressly incorporated by reference.

BACKGROUND

1. Technical Field

The present invention relates to a liquid ejecting apparatus, such as an ink jet type printer, which ejects liquid.

2. Related Art

Hitherto, an ink jet type printer which performs printing on a medium in such a manner that liquid (ink) is ejected onto the medium (a paper sheet) through nozzles formed on a liquid ejecting head has been known as an example of a liquid ejecting apparatus. To maintain favorable liquid ejection performance of the liquid ejecting head, some of such printers include a maintenance device having a wiper which wipes a nozzle forming surface of the liquid ejecting head and removes liquid or a piece (paper dust) of medium adhering to the nozzle forming surface.

Some of such maintenance devices have a configuration in which a wiper wipes the nozzle forming surface in a state where the ink leaked from the nozzles is held in the nozzle forming surface (for example, see JP-A-2010-179512). Specifically, when the liquid held in the nozzle forming surface is drawn into the nozzles, the wiper of the maintenance device wipes the nozzle forming surface.

However, since, when the ink held in the nozzle forming surface is drawn into the nozzles, the wiper of the above-described maintenance device wipes the nozzle forming surface, there is a concern that the wiper may push air bubbles into the nozzles. In this case, the air bubbles enter the inner side of the liquid ejecting head (the nozzles), and thus the favorable liquid ejection performance of the liquid ejecting head cannot be maintained in some cases.

The problem described above is not limited to an ink jet type printer but is generally shared by a liquid ejecting apparatus including a liquid ejecting head which ejects liquid and has a nozzle forming surface having nozzles formed thereon.

SUMMARY

An advantage of some aspects of the invention is to provide a liquid ejecting apparatus which can maintain favorable liquid ejection performance of a liquid ejecting head for ejecting liquid, in such a manner that a nozzle forming surface of the liquid ejecting head is wiped.

Hereinafter, means of the invention and operational effects thereof will be described.

According to an aspect of the invention, there is provided a liquid ejecting apparatus which includes a liquid ejecting head which ejects liquid supplied from a supply source and has a nozzle forming surface having nozzles formed therein, a pressurizing portion which is located further to the supply source side than the nozzles and can pressurize the liquid supplied to the nozzles, and a wiper which has a first surface and a second surface capable of wiping the nozzle forming surface and is elastically deformable, in which a first wiping operation in which the first surface wipes the nozzle forming surface while setting a contact pressure with respect to the nozzle forming surface to a first contact pressure, in a state where the pressurizing portion is driven and the pressure of liquid in the nozzles is set to be equal to or greater than atmospheric pressure and a second wiping operation in which the second surface wipes the nozzle forming surface wiped by the first surface while setting the contact pressure with respect to the nozzle forming surface to a second contact pressure less than the first contact pressure are performed.

In this case, the first wiping operation in which the first surface wipes the nozzle forming surface is performed in a state where the pressurizing portion pressurizes the liquid in the nozzles to a value equal to or greater than atmospheric pressure. As a result, it is difficult for the first surface to push air bubbles into the nozzles, during the first wiping operation.

When, during the first wiping operation, the first surface comes into contact with the liquid in the nozzles, of which the pressure is pressurized to the value equal to or greater than atmospheric pressure, and the liquid leaks from the nozzles, the leaked liquid is removed in the second wiping operation in which the second surface wipes the nozzle forming surface. In this case, the contact pressure (the second contact pressure) between the wiper and the nozzle forming surface, during the second wiping operation, is set to be less than the contact pressure (the first contact pressure) between the wiper and the nozzle forming surface, during the first wiping operation. As a result, compared to in the case where the wiper wipes the nozzle forming surface with the first contact pressure, the second surface is prevented from pushing air bubbles into the nozzles, during the second wiping operation. Furthermore, it is difficult for the second surface to come into contact with the liquid in the nozzles, during the second wiping operation, and thus the liquid is prevented from leaking through the nozzles.

Accordingly, when the wiper wipes the nozzle forming surface, it is possible to remove the attached material from the nozzle forming surface, while preventing the wiper from pushing air bubbles into the nozzles. As a result, it is possible to maintain favorable liquid ejection performance of the liquid ejecting head.

In the liquid ejecting apparatus, it is preferable that the liquid ejecting apparatus further include a wiper supporting portion which supports the wiper in a state where the wiper supporting portion allows pivoting of the wiper on the base side, during the second wiping operation.

In this case, since pivoting of the wiper on the base side is allowed in the second wiping operation, the amount of elastic displacement of the wiper in the second wiping operation is likely to be reduced, compared to in the case where pivoting of the wiper on the base side is regulated. That is, the restoring force of the wiper corresponding to the amount of displacement is reduced, and thus the contact pressure of the wiper with respect to the nozzle forming surface is likely to be reduced. Accordingly, since such a support configuration relative to the wiper is applied, it is possible to easily reduce the contact pressure between the wiper and the nozzle forming surface, during the second wiping operation.

In the liquid ejecting apparatus, it is preferable that the wiper supporting portion include a regulation portion which regulates pivoting of the wiper with respect to the wiper supporting portion, during the first wiping operation and an elastic member which applies a reaction force corresponding to the amount of pivoting of the wiper to the wiper, during the second wiping operation.

In this case, pivoting of the wiper is regulated by the regulation portion, during the first wiping operation, and pivoting of the wiper is allowed in the second wiping operation. Accordingly, the amount of elastic displacement of the wiper in the first wiping operation is likely to be greater than that in the second wiping operation, and thus the first contact pressure is likely to be greater than the second contact pressure. Accordingly, the contact pressure between the wiper and the nozzle forming surface, during the second wiping operation, can be set to be less than the contact pressure between the wiper and the nozzle forming surface, during the first wiping operation, in such a manner that the amount of pivoting of the wiper is controlled.

When the second wiping operation is performed, the elastic member applies, to the wiper, the reaction force corresponding to the amount of pivoting. As a result, it is possible to easily uniformize the amount of elastic displacement of the wiper in the second wiping operation, compared to in the case where the elastic member is not provided. As a result, it is possible to easily uniformize the second contact pressure.

In the liquid ejecting apparatus, it is preferable that the first surface have a convex-curved surface in a movement direction of the wiper in the first wiping operation, relative to the liquid ejecting head. In addition, it is preferable that the second surface have a flat surface intersecting a movement direction of the wiper in the second wiping operation, relative to the liquid ejecting head.

In this case, the contact area between the first surface and the nozzle forming surface, during the first wiping operation, is likely to be smaller than the contact area between the second surface and the nozzle forming surface, during the second wiping operation. In other words, the first contact pressure in the first wiping operation is likely to be greater than the second contact pressure in the second wiping operation. As a result, according to the configuration described above, since the wiper has the shape, the contact pressure between the wiper and the nozzle forming surface, during the second wiping operation, can be set to be less than the contact pressure between the wiper and the nozzle forming surface, during the first wiping operation.

In the liquid ejecting apparatus, it is preferable that the liquid ejecting apparatus further include a changing mechanism which changes the amount of interference between the wiper and the nozzle forming surface, in a direction intersecting the nozzle forming surface. In addition, it is preferable that the changing mechanism set the amount of interference in the first wiping operation to be greater than the amount of interference in the second wiping operation.

In this case, the amount of interference between the wiper and the nozzle forming surface is great in the first wiping operation. Accordingly, when the wiper wipes the nozzle forming surface, the amount of elastic displacement of the wiper is likely to increase, and thus the first contact pressure is likely to increase due to the restoring force of the wiper corresponding to the amount of displacement. In contrast, the amount of interference between the wiper and the nozzle forming surface is small in the second wiping operation. Accordingly, when the wiper wipes the nozzle forming surface, the amount of elastic displacement of the wiper is likely to be reduced, and thus the second contact pressure is likely to be reduced due to the restoring force of the wiper corresponding to the amount of displacement. As a result, the contact pressure between the wiper and the nozzle forming surface, during the second wiping operation, can be set to be less than the contact pressure between the wiper and the nozzle forming surface, during the first wiping operation, in such a manner that the amount of interference between the wiper and the nozzle forming surface is adjusted.

In the liquid ejecting apparatus, it is preferable that the hardness of the first surface side of the wiper be less than that of the second surface side.

In this case, when the second wiping operation is performed, the nozzle forming surface is wiped by the second surface having the hardness higher than that of the first surface. Thus, when the second wiping operation is performed, elastic displacement of the second surface is suppressed, and thus it is difficult for the second surface to enter the nozzles. In other words, when the second wiping operation is performed, it is possible to further prevent the second surface from coming into contact with the liquid in the nozzles.

In the liquid ejecting apparatus, it is preferable that the liquid ejecting apparatus further include a controller which controls a wiping operation of the wiper and a liquid leakage detection portion which detects whether liquid leaks from the nozzles, during the first wiping operation. In addition, it is preferable that, when the liquid leakage detection portion detects leakage of the liquid from the nozzles, the controller perform the second wiping operation.

When, during the first wiping operation, liquid does not leak from the nozzles, it is not necessary to perform the second wiping operation. In contrast, when, during the first wiping operation, liquid leaks from the nozzles, it is necessary to perform the second wiping operation. In the configuration described above, since it can be configured so that the second wiping operation is performed only when it is necessary to perform the second wiping operation, it is possible to increase efficiency of a wiping operation with respect to the nozzle forming surface.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1

Hereinafter, Embodiment 1 of a liquid ejecting apparatus will be described with reference to the accompanying drawings. The liquid ejecting apparatus is an ink jet type printer which performs printing in such a manner that, for example, ink as an example of liquid is ejected onto a medium, such as a paper sheet.

Figures 1A, 1B:
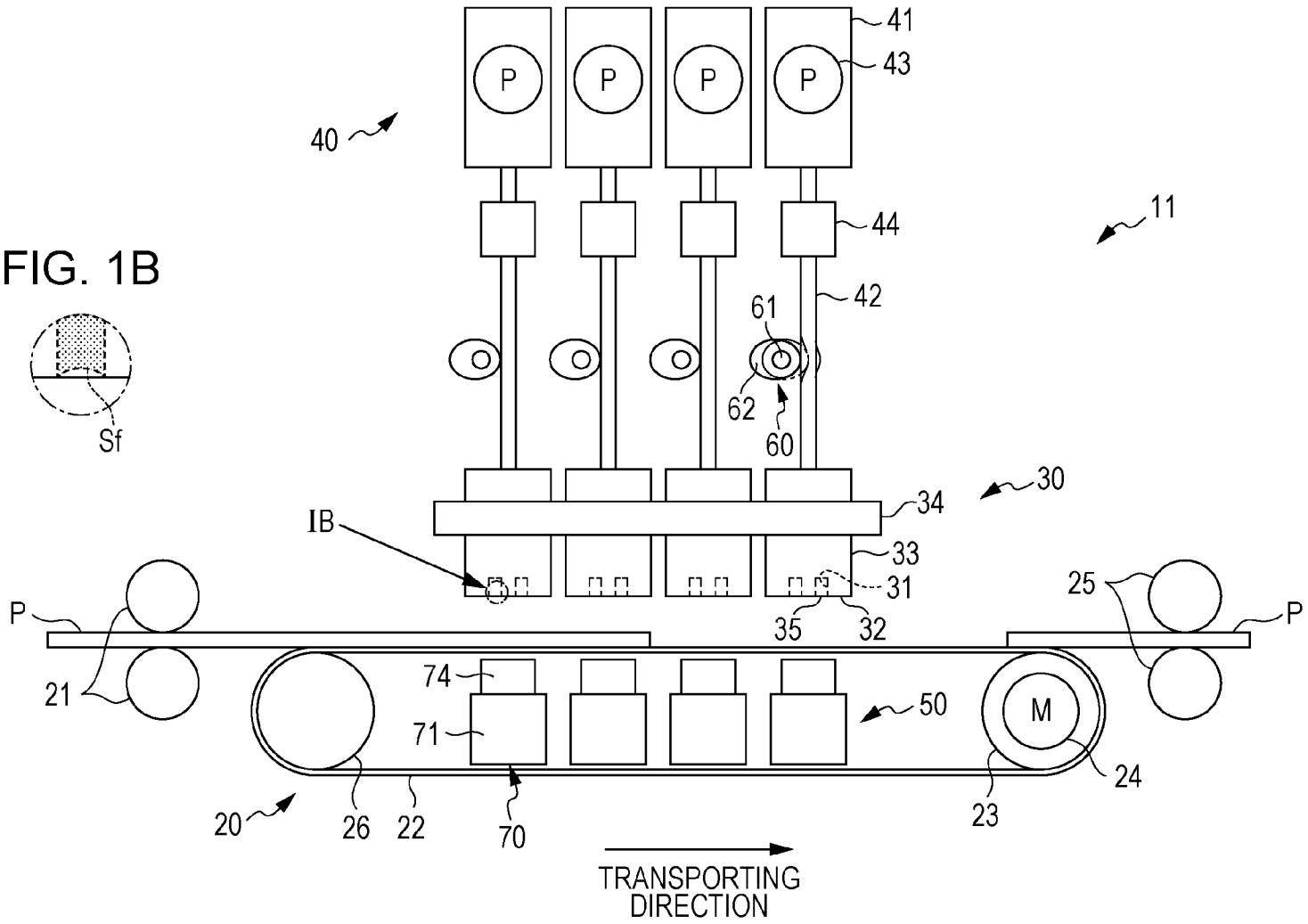
FIG. 1A is a side view illustrating the schematic configuration of a liquid ejecting apparatus of Embodiment 1 and FIG. 1B is an enlarged view of a nozzle.

A liquid ejecting apparatus 11 includes a transporting portion 20 for transporting a medium P, such as a paper sheet, a liquid ejecting portion 30 for ejecting liquid onto the medium P, a liquid supply portion 40 for supplying the liquid to the liquid ejecting portion 30, and a maintenance portion 50 for performing maintenance of the liquid ejecting portion 30, as illustrated in FIG. 1A. In the following description, both an upstream side and a downstream side are defined in accordance with a supplying direction of the liquid. In other words, the liquid supply portion 40 is located on the upstream side in a liquid supply system and the liquid ejecting portion 30 is located on the downstream side.

The transporting portion 20 includes a feeding roller 21 for feeding the medium P, a transporting belt 22 having an endless belt shape, a driving roller 23 for driving the transporting belt 22, a driving motor 24 for rotationally driving the driving roller 23, a driven roller 26 which forms a pair with the driving roller 23, and a transporting roller 25 for transporting the medium P. The transporting belt 22 is wound around both the driving roller 23 and the driven roller 26. The transporting belt 22 circulates in such a manner that the driving roller 23 rotates in accordance with driving of the driving motor 24. Thus, in the transporting portion 20, the medium P is transported in a transporting direction by the feeding roller 21, the transporting belt 22, and the transporting roller 25. A plurality (for example, two) of transporting belts 22 are provided such that the transporting belts 22 support at least both ends of the medium P in a width direction (which is a direction perpendicular to the paper surface of FIGS. 1A and 1B) perpendicular to the transporting direction of the medium P. In the width direction, the maintenance portion 50 is disposed in a portion between the transporting belts 22.

The liquid ejecting portion 30 includes a liquid ejecting head 33 and a supporting portion 34. The liquid ejecting head 33 ejects the liquid and has a nozzle forming surface 32 on which nozzles 31 are formed. The supporting portion 34 supports the liquid ejecting head 33. A plurality of nozzles 31 through which the liquid is ejected are aligned in the width direction of the medium P, and thus a row of nozzles is formed in the liquid ejecting head 33. The inner wall of each nozzle 31 is subjected to a hydrophilic membrane treatment to increase an affinity (in other words, wettability) to liquid. The opening of each nozzle 31 in the nozzle forming surface 32 of the liquid ejecting head 33 is referred to also as a nozzle opening 35. Although the liquid ejecting head 33 of this embodiment is a line-type head having two nozzle rows formed therein, the number of nozzle rows may not be limited thereto. Furthermore, the liquid ejecting head 33 may be a serial type head which reciprocates in the width direction of the medium P and ejects liquid.

A plurality (four, in this embodiment) of liquid ejecting heads 33 are provided in accordance with kinds of liquid. When color printing of four colors, for example, cyan, magenta, yellow, and black is performed in a printer as an example of the liquid ejecting apparatus 11, four liquid ejecting heads 33 are provided in accordance with the colors. Printing is performed on the medium P in such a manner that the four liquid ejecting heads 33 repeatedly eject ink droplets of the four colors onto the transported medium P.

The liquid supply portion 40 includes a liquid storing body 41 and a supply tube 42. The liquid storing body 41 is an example of a supply source for storing liquid which is supplied to the liquid ejecting head 33. The supply tube 42 supplies the liquid from the liquid storing body 41 to the liquid ejecting head 33 side and is elastically deformable. In addition, the liquid supply portion 40 includes a pressure pump 43 and a differential pressure regulating valve 44. The pressure pump 43 supplies the liquid to the liquid ejecting head 33 side, in a pressurizing manner. When the pressure of the liquid on the downstream side is less than a predetermined pressure, that is, less than atmospheric pressure, the differential pressure regulating valve 44 is opened.

A plurality (four, in this embodiment) of liquid storing bodies 41 are provided in accordance with the liquid ejecting heads 33. The liquid storing body 41 may be a liquid storing body of a type in which liquid is stored in a pack type container or may be a liquid storing body of a type in which liquid is stored in a cartridge type container. The differential pressure regulating valve 44 is provided in the middle of the supply tube 42. The differential pressure regulating valve 44 adjusts the pressure of the liquid further on the downstream side than the differential pressure regulating valve 44, to be less than atmospheric pressure. Accordingly, the pressure of the liquid in each nozzle 31 is set to be less than atmospheric pressure, and thus a liquid surface Sf (a meniscus) having a concave shape in relation to a liquid ejecting direction is formed, as illustrated in FIG. 1B. The concave shape of the liquid surface Sf also results from the above-described membrane treatment performed on the inner wall of each nozzle 31.

Next, the maintenance portion 50 will be described with reference to FIGS. 1A to 2B.

The maintenance portion 50 includes a pressurizing portion 60 and a wiping device 70, as illustrated in FIGS. 1A and 1B. The pressurizing portion 60 pressurizes the liquid supplied to the nozzles 31, in such a manner that the pressurizing portion 60 compresses the supply tube 42. The wiping device 70 removes the attached material (for example, paper dust and ink) on the nozzle forming surface 32, in such a manner that the wiping device 70 wipes the nozzle forming surface 32. Both the pressurizing portion 60 and the wiping device 70 are provided for each liquid ejecting head 33. Furthermore, the maintenance portion 50 may be provided with a cap device (not illustrated) which closes a space including the nozzle openings 35 of the nozzles 31 and prevents volatilizing of the liquid (in other words, the liquid in the nozzles 31) in the liquid ejecting head 33.

The pressurizing portion 60 includes a rotation shaft 61 and a cam member 62 which rotates along with the rotation shaft 61. The pressurizing portion 60 pressurizes both the liquid in a part of the supply tube 42, which is a portion located further on the downstream side than the differential pressure regulating valve 44, and the liquid in the liquid ejecting head 33, in such a manner that the cam member 62 squeezes the supply tube 42 in accordance with the rotation of the rotation shaft 61 in a normal direction, as illustrated by a double-dashed line in FIG. 1A. When the cam member 62 of the pressurizing portion 60 rotates in a reverse direction and returns to the initial position, the pressurized state described above is released. Thus, the pressurizing portion 60 can pressurize the liquid supplied to the nozzles 31, at the position further on the liquid storing body 41 side than the nozzles 31.

Figure 2A:
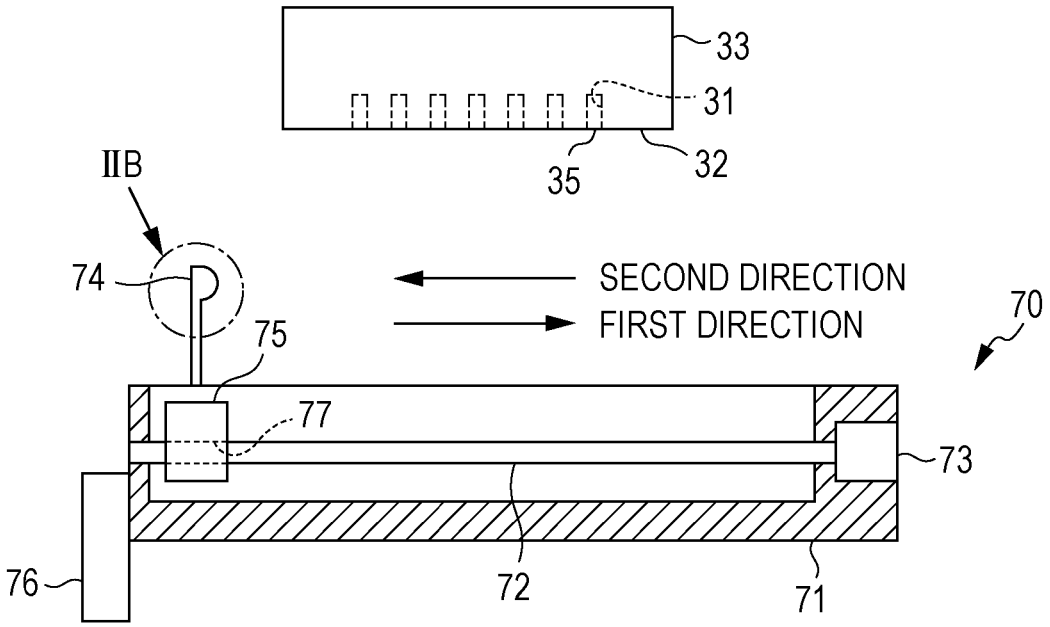
FIG. 2A is a schematic view illustrating the schematic configuration of a wiping device of Embodiment 1 and FIG. 2B is an enlarged view of a wiper constituting the wiping device.

The wiping device 70 includes a base portion 71, a lead screw 72, and a motor 73, as illustrated in FIG. 2A. The base portion 71 constitutes a base portion of the wiping device 70. The lead screw 72 is suspended across the base portion 71, in a longitudinal direction which is a nozzle row direction (a right-left direction in FIG. 2A) of the liquid ejecting head 33. The motor 73 rotates the lead screw 72. The wiping device 70 includes a wiper 74 and a wiper support portion 75. The wiper 74 is formed of an elastic body, such as rubber, and has a substantial plate shape. The wiper support portion 75 supports the wiper 74 and is supported by the lead screw 72.

Furthermore, the wiping device 70 includes a lifting mechanism 76 which causes the wiping device 70 to ascend/descend with respect to the liquid ejecting head 33.

Figure 2B:
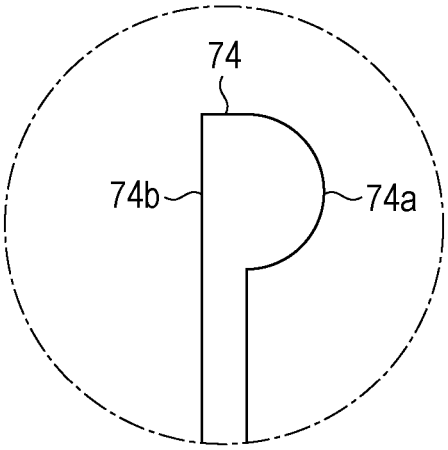

The wiper 74 has a first surface 74*a* and a second surface 74*b* which can wipe the nozzle forming surface 32, as illustrated in FIG. 2B. The first surface 74*a* is convexly curved in a direction (which is a first direction) in which the wiper 74 moves relative to the liquid ejecting head 33 while the first surface 74*a* wipes the nozzle forming surface 32. In contrast, the second surface 74*b* has a flat surface shape intersecting (perpendicular, in this embodiment) a direction (which is a second direction) in which the wiper 74 moves relative to the liquid ejecting head 33 while the second surface 74*b* wipes the nozzle forming surface 32. In the movement direction of the wiper 74, the first surface 74*a* is located opposite to the second surface 74*b*. The shape of the wiper 74 in the width direction (which is a direction perpendicular to the paper surface of FIGS. 2A and 2B) is the same.

A guiding portion 77 into which the lead screw 72 is screwed is formed in the wiper support portion 75, as illustrated in FIG. 2A. Accordingly, the wiper support portion 75 can move in the first direction or the second direction, in accordance with the rotation of the lead screw 72 in the normal direction or the reverse direction. A storage portion may be provided to store liquid which adheres to the wiper 74 during wiping of the nozzle forming surface 32 and flows downward from the wiper 74 to the wiper support portion 75.

The lifting mechanism 76 can cause the wiping device 70 to move (ascend) close to a position at which the wiping device 70 can wipe the nozzle forming surface 32 and can cause the wiping device 70 to retreat (descend) to a position at which the wiping device 70 cannot wipe the nozzle forming surface 32. Accordingly, the lifting mechanism 76 corresponds to an example of a changing mechanism which changes the amount (the amount of overlapping) of interference between the wiper 74 and the nozzle forming surface 32, in relation with a direction (a vertical direction) intersecting the nozzle forming surface 32.

Next, the operation of the wiping device 70 of Embodiment 1 will be described.

When the liquid ejecting head 33 of the liquid ejecting apparatus 11 continuously ejects the liquid onto the transported medium P, a piece (for example, paper dust) of medium or liquid adheres to the nozzle forming surface 32 of the liquid ejecting head 33. As a result, in some cases, the liquid ejection performance of the liquid ejecting head 33 is deteriorated. Thus, in such a case, the wiper 74 wipes the nozzle forming surface 32 to remove the attached material from the nozzle forming surface 32 of the liquid ejecting head 33. In this case, to prevent the wiper 74 from pushing air bubbles into the nozzles 31, wiping (hereinafter, referred to also as a "pressurized wiping") of the nozzle forming surface 32 is performed in a state where the liquid in the nozzles 31 is pressurized.

Figure 3A:
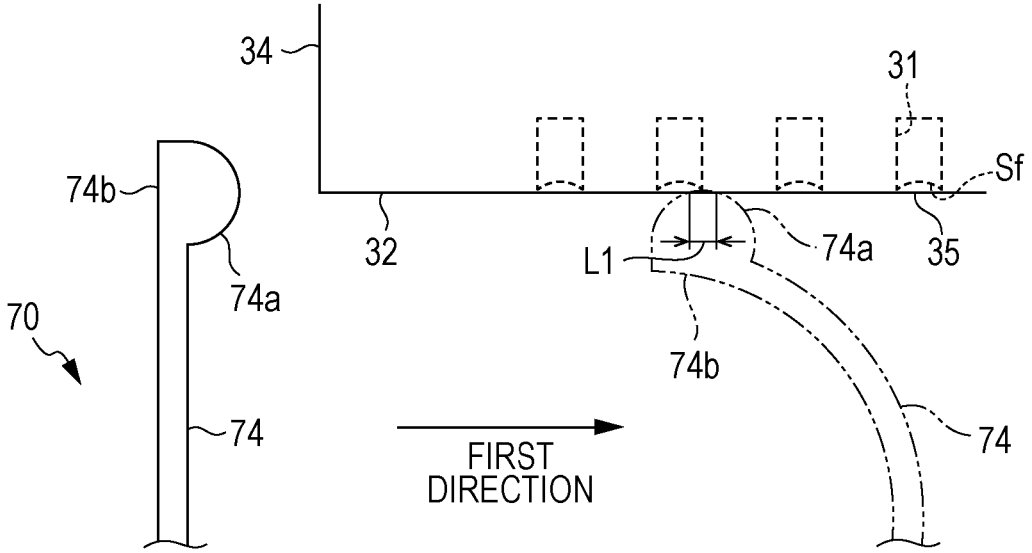
FIG. 3A is a view illustrating a first wiping operation of the wiping device of Embodiment 1 and FIG. 3B is a view illustrating a second wiping operation.
Figure 3B:
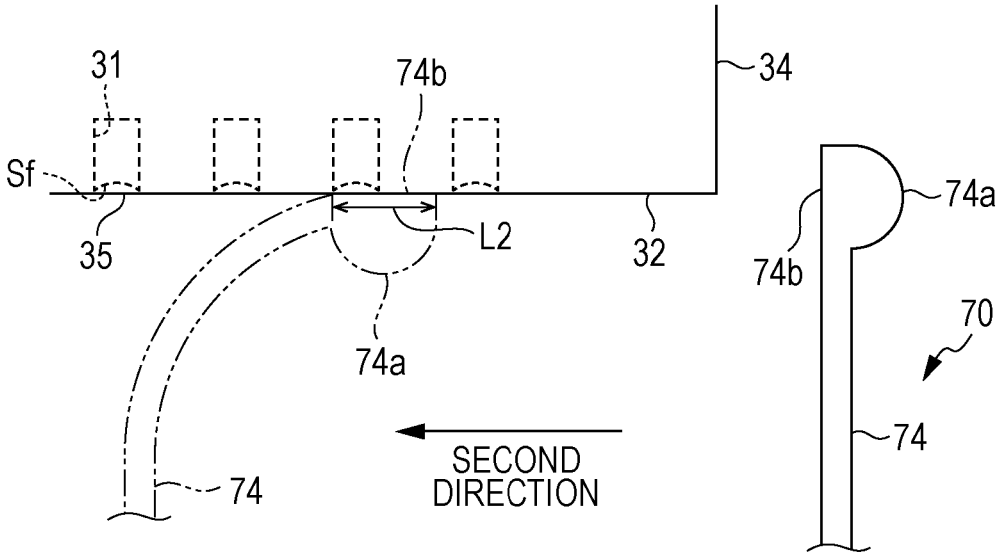

When the pressurized wiping is performed, the lifting mechanism 76 is driven and the wiping device 70 (the wiper 74) ascends to the position at which the wiping device 70 can wipe the nozzle forming surface 32, as illustrated in FIGS. 3A and 3B. In addition, the pressure in the nozzles 31 is set to be within the range which is equal to or greater than atmospheric pressure and is less than a meniscus withstanding pressure, in such a manner that the pressure of the liquid which is located further on the downstream side than the differential pressure regulating valve 44 is pressurized by driving the pressurizing portion 60. As a result, the liquid surface Sf in each nozzle 31 is located closer to the nozzle opening 35, compared to the state (which is the state illustrated in FIG. 1B) where the liquid is not subjected to pressurizing. The meniscus withstanding pressure referred to in this case means the pressure at which the liquid can be held in the nozzles 31. When the pressure of the liquid in the nozzles 31 exceeds the meniscus withstanding pressure, the liquid cannot be held in the nozzles 31, and thus the liquid leaks from the nozzle openings 35.

Subsequently, the wiping device 70 performs a first wiping operation in which the first surface 74*a* wipes the nozzle forming surface 32. In other words, the lead screw 72 is rotated by driving the motor 73, and thus the wiper 74, along with the wiper support portion 75, is moved in the first direction. In this case, the first surface 74*a* of the wiper 74 slides on the nozzle forming surface 32, and thus the attached material is removed from the nozzle forming surface 32. Next, when the first wiping operation is finished, the wiping device 70 performs a second wiping operation in which the second surface 74*b* wipes the nozzle forming surface 32, as illustrated in FIG. 3B. In other words, the lead screw 72 is rotated in a reverse direction in such a manner that the motor 73 is driven in a direction opposite to the direction in the first wiping operation, and thus the wiper 74, along with the wiper support portion 75, is moved in the second direction. In this case, the second surface 74*b* of the wiper 74 slides on the nozzle forming surface 32. In Embodiment 1, both the first wiping operation and the second wiping operation have the same amount of interference between the wiper 74 and the nozzle forming surface 32, in relation with the direction (which is the vertical direction in FIGS. 3A and 3B) intersecting with the nozzle forming surface 32, as illustrated in FIGS. 3A and 3B.

In this case, the length L1 of a part of the first surface 74*a* in a wiping direction, which is a portion in contact with the nozzle forming surface 32 during the first wiping operation, is shorter than the length L2 of a part of the second surface 74*b* in the wiping direction, which is a portion in contact with the nozzle forming surface 32 during the second wiping operation, as illustrated in FIGS. 3A and 3B. Accordingly, the area of a part of the first surface 74*a*, which is the portion in contact with the nozzle forming surface 32 during the first wiping operation, is smaller than the area of a part of the second surface 74*b*, which is the portion in contact with the nozzle forming surface 32 during the second wiping operation. Furthermore, the contact force between the wiper 74 and the nozzle forming surface 32 is not greatly different between the first wiping operation and the second wiping operation, and thus the contact pressure which is obtained by dividing the contact force by the contact area is large in the first wiping operation, compared to the second wiping operation. In other words, the contact pressure (that is, the first contact pressure) between the wiper 74 and the nozzle forming surface 32 during the first wiping operation is greater than the contact pressure (that is, the second contact pressure) between the wiper 74 and the nozzle forming surface 32, during the second wiping operation.

In some cases, during the first wiping operation, the wiper 74 is displaced and the first surface 74*a* enters the nozzles 31, and thus the first surface 74*a* comes into contact with the liquid in the nozzles 31. In this case, the liquid leaks from the nozzles 31 along the first surface 74*a* and the leaked ink adheres to the nozzle forming surface 32. However, in this embodiment, the second wiping operation having the small contact pressure with respect to the nozzle forming surface 32, compared to the first wiping operation, is performed. Thus, the second surface 74*b* removes the liquid adhering to the nozzle forming surface 32, in a state where the second surface 74*b* is prevented from pushing air bubbles into the nozzles 31.

In contrast, in a case where the liquid does not leak from the nozzles 31 during the first wiping operation, even when the second wiping operation is performed, the second surface 74*b* is prevented from coming into contact with the liquid in the nozzles 31. The reason for this is that the second wiping operation has the small contact pressure with respect to the nozzle forming surface 32, compared to the first wiping operation. In other words, in this case, leaking of liquid from the nozzles 31, resulting from contact between the second surface 74*b* and the liquid in the nozzles 31, is prevented in the second wiping operation.

According to the embodiment described above, the following effects can be obtained.

(1) Since the first surface 74*a* wipes the nozzle forming surface 32, in a state where the pressurizing portion 60 pressurizes the liquid in the nozzles 31 to a value equal to or greater than atmospheric pressure, it is difficult for the first surface 74*a* to push air bubbles into the nozzles 31 (during the first wiping operation). When the liquid leaks from the nozzles 31 during the first wiping operation, the leaked ink is removed by the second surface 74*b* wiping the nozzle forming surface 32 (during the second wiping operation). In this case, since the second wiping operation has the small contact pressure with respect to the nozzle forming surface 32, compared to the first wiping operation, the second surface 74*b* is prevented from pushing air bubbles into the nozzles 31. Accordingly, when the nozzle forming surface 32 is wiped in a state where the liquid in the nozzles 31 is pressurized, it is possible to remove the attached material on the nozzle forming surface 32, while preventing air bubbles from being pushed into the nozzles 31. As a result, it is possible to maintain favorable liquid ejection performance of the liquid ejecting head 33.

(2) Since the first surface 74*a* has a convex-curved surface shape and the second surface 74*b* has a flat surface shape, the contact area between the first surface 74*a* and the nozzle forming surface 32, during the first wiping operation, is likely to be smaller than the contact area between the second surface 74*b* and the nozzle forming surface 32, during the second wiping operation. In other words, since the wiper 74 has the shape described above, the second contact pressure can be set to be less than the first contact pressure.

(3) Since the first wiping operation is performed by moving the wiper 74 in the first direction and the second wiping operation is performed by moving the wiper 74 in the second direction, both the first wiping operation and the second wiping operation can be performed in the reciprocation operation of the wiper 74. Furthermore, the first surface 74*a* of the wiper 74 is used in the first wiping operation and the second surface 74*b* is used in the second wiping operation. As a result, the attached material can be effectively removed from the nozzle forming surface 32, in such a manner that the wiper 74 reciprocates in the first/second direction without change in the oriented direction of the wiper 74.

Embodiment 2

Hereinafter, Embodiment 2 of the liquid ejecting apparatus will be described with reference to the accompanying drawings.

In Embodiment 2, the support configuration of the wiper support portion 75, relative to the wiper 74, is changed from that in Embodiment 1. In this way, the contact pressure between the wiper 74 and the nozzle forming surface 32, during the second wiping operation, is set to be less than the contact pressure between the wiper 74 and the nozzle forming surface 32, during the first wiping operation. Accordingly, the same reference numerals and characters are given to components having the same configurations as those in Embodiment 1. The descriptions thereof will not be repeated or will be simplified.

Figure 4A:
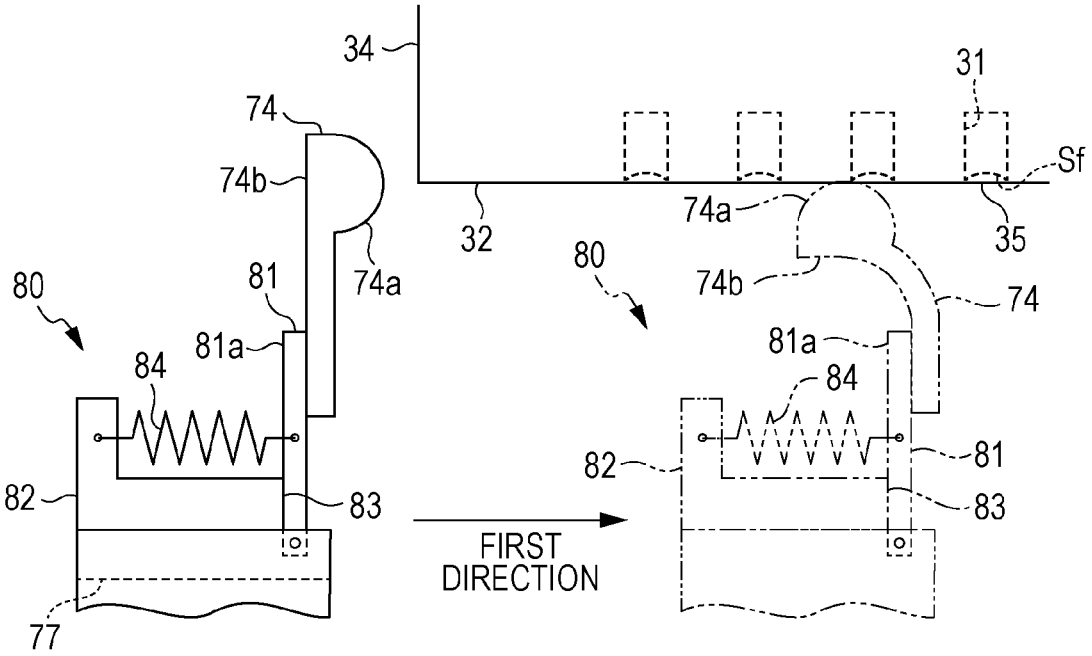
FIG. 4A is a view illustrating a first wiping operation of a wiping device of Embodiment 2 and FIG. 4B is a view illustrating a second wiping operation.
Figure 4B:
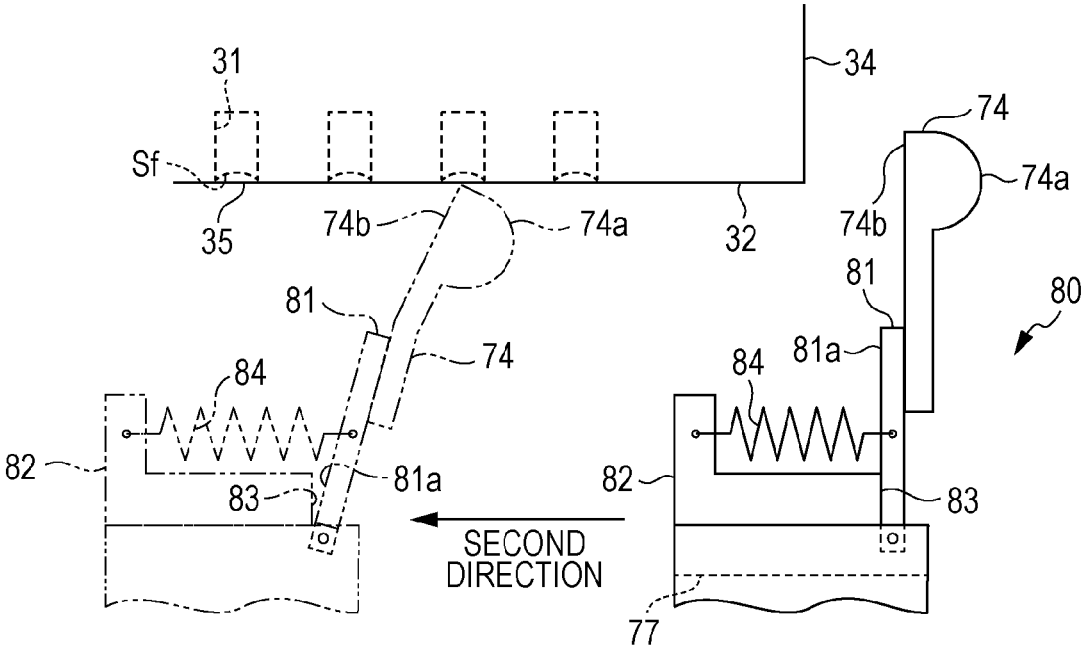

A wiping device 80 of Embodiment 2 includes the wiper 74, a pivoting member 81, and a wiper supporting portion 82, as illustrated in FIGS. 4A and 4B. The pivoting member 81 supports the wiper 74. The wiper supporting portion 82 pivotally supports the pivoting member 81.

The base portion of the pivoting member 81 is pivotally supported by the wiper supporting portion 82, in a state where the direction intersecting the movement direction (which is the direction perpendicular to the paper surface of FIGS. 4A and 4B) of the wiper 74 is set to a rotation axis direction. In the pivoting member 81, the tip side opposite to the base portion side supports the wiper 74. The pivoting member 81 has the elastic modulus in which the pivoting member 81 is not elastically deformed during the wiping operation of the wiper 74.

The wiper supporting portion 82 includes the guiding portion 77, a regulation portion 83, and an elastic member 84. The regulation portion 83 regulates a pivoting operation (which is the pivoting operation in the counterclockwise direction in FIGS. 4A and 4B) of the pivoting member 81, in such a manner that the regulation portion 83 comes into contact with a contact surface 81*a* of the pivoting member 81, which is the surface on the second direction side. The elastic member 84 applies, to the pivoting member 81, the reaction force corresponding to the amount of pivoting of the pivoting member 81. The elastic member 84 is a biasing member, such as a coil spring. The elastic member 84 is provided in a state where the elastic member 84 connects the wiper supporting portion 82 and the pivoting member 81. As a result, pivoting of the pivoting member 81 in one direction (which is the counterclockwise direction in FIGS. 4A and 4B) is regulated with respect to the wiper supporting portion 82. In addition, pivoting of the pivoting member 81 in the other direction (which is the clockwise direction in FIGS. 4A and 4B) is allowed with respect to the wiper supporting portion 82. In this embodiment, the pivoting member 81 supports the wiper 74. Thus, it is possible to say that the wiper 74 is supported, via the pivoting member 81, by the wiper supporting portion 82, in a state where pivoting of the wiper 74 in one direction (which is the counterclockwise direction in FIGS. 4A and 4B) is regulated with respect to the wiper supporting portion 82 and pivoting of the wiper 74 in the other direction (which is the clockwise direction in FIGS. 4A and 4B) is allowed with respect to the wiper supporting portion 82.

Next, the operation of the wiping device 80 of Embodiment 2 will be described.

When the pressurized wiping is performed, as illustrated in FIGS. 4A and 4B, the lifting mechanism 76 is driven and the wiping device 80 ascends to the position at which the wiping device 80 can wipe the nozzle forming surface 32. Furthermore, the pressure of the liquid in the nozzles 31 is pressurized by driving the pressurizing portion 60.

The first wiping operation in which the first surface 74*a* wipes the nozzle forming surface 32 is performed by the wiping device 80, in such a manner that the wiping device 80 causes the wiper 74, along with the wiper supporting portion 82, to move in the first direction. In this case, when the first wiping operation is performed, the wiper 74 slides on the nozzle forming surface 32, and thus load in a direction (which is the second direction) opposite to a traveling direction is applied to both the wiper 74 and the pivoting member 81. Accordingly, the wiper 74 is displaced falling down in the direction opposite to the first direction and the pivoting member 81 pivots falling down in the direction opposite to the first direction. However, since the contact surface 81*a* comes into contact with the regulation portion 83 of the wiper supporting portion 82, pivoting of the pivoting member 81 is regulated. As a result, the wiping operation is performed in a state where the pivoting member 81 is prevented from pivoting.

Then, when the first wiping operation is finished, the second wiping operation in which the second surface 74*b* wipes the nozzle forming surface 32 is performed by the wiping device 80, in such a manner that the wiping device 80 causes the wiper 74, along with the wiper supporting portion 82, to move in the second direction, as illustrated in FIG. 4B. In Embodiment 2, both the first wiping operation and the second wiping operation also have the same amount (that is, the amount of overlapping) of interference between the wiper 74 and the nozzle forming surface 32, as illustrated in FIGS. 4A and 4B. When the second wiping operation is performed, the wiper 74 slides on the nozzle forming surface 32, and thus load in a direction (which is the first direction) opposite to the traveling direction is applied to both the wiper 74 and the pivoting member 81. Accordingly, the wiper 74 is displaced falling down in the direction opposite to the second direction and the pivoting member 81 pivots falling down in the direction opposite to the second direction.

In this case, pivoting of the pivoting member 81 is not regulated, not similarly to the case of the first wiping operation, and thus the pivoting member 81 pivots falling down in the direction opposite to the second direction. Accordingly, since the 81 pivots, the amount of elastic displacement of the wiper 74 in the second wiping operation is less than that in the first wiping operation. Therefore, the restoring force of the wiper 74 is also reduced in accordance with the amount of displacement. As a result, the contact force between the wiper 74 and the nozzle forming surface 32 is reduced, and thus the second contact pressure in the second wiping operation is less than the first contact pressure in the first wiping operation. In this case, in some cases, the contact area between the wiper 74 and the nozzle forming surface 32, during the first wiping operation, is greater than that in the second wiping operation, as illustrated in FIGS. 4A and 4B. Thus, it is preferable that, for example, the elastic modulus of the wiper 74 be set to the value in which the second contact pressure is less than the first contact pressure.

When the second wiping operation is performed, the elastic member 84 applies, via the pivoting member 81, to the wiper 74, the reaction force corresponding to the amount of pivoting. Accordingly, the amount of elastic displacement of the wiper 74 is uniformized, compared to in the case where the elastic member 84 is not provided. As a result, the second contact pressure is likely to be uniformized.

Therefore, even in a case where, during the first wiping operation, the first surface 74*a* comes into contact with the liquid in the nozzles 31 and the liquid leaks from the nozzles 31, when the second wiping operation having a small contact pressure with respect to the nozzle forming surface 32 is performed, the second surface 74*b* removes the liquid adhering to the nozzle forming surface 32, in a state where the second surface 74*b* is prevented from pushing air bubbles into the nozzles 31.

According to the embodiment described above, the following effects, in addition to the effects (1) to (3) of Embodiment 1, can be obtained.

(4) Since pivoting of the wiper 74 on the base side is allowed in the second wiping operation, the amount of elastic displacement of the wiper 74 is likely to be reduced in the wiping operation, compared to in the case where pivoting of the wiper 74 on the base side is regulated. As a result, the contact pressure with respect to the nozzle forming surface 32 is likely to be reduced. Accordingly, since such a support configuration relative to the wiper 74 is applied, it is possible to easily reduce the contact pressure between the wiper 74 and the nozzle forming surface 32, during the second wiping operation.

(5) Pivoting of the wiper 74 (the pivoting member 81) falling down in the second direction is regulated in the first wiping operation and pivoting of the wiper 74 falling down in the first direction is allowed in the second wiping operation. Accordingly, the amount of elastic displacement of the wiper 74 in the first wiping operation is likely to be greater than that in the second wiping operation, and thus the first contact pressure is likely to be greater than the amount of elastic displacement of the wiper 74 in the second contact pressure. As a result, the second contact pressure can be easily set to be less than the first contact pressure, in such a manner that the amount of pivoting of the wiper 74 is regulated or allowed.

(6) When the second wiping operation is performed, the elastic member 84 applies, to the wiper 74, the reaction force corresponding to the amount of pivoting. As a result, it is possible to easily uniformize the second contact pressure, compared to in the case where the elastic member 84 is not provided.

Embodiment 3

Hereinafter, Embodiment 3 of the liquid ejecting apparatus will be described with reference to the accompanying drawings.

In Embodiment 3, the contact pressure between the wiper 74 and the nozzle forming surface 32, during the second wiping operation, is set to be less than that in the first wiping operation, in such a manner that the amount of interference of the wiper 74 in the first wiping operation is set to be greater than that in the second wiping operation. Accordingly, the same reference numerals and characters are given to components having the same configurations as those in Embodiment 1. The descriptions thereof will not be repeated or will be simplified.

Figure 5A:
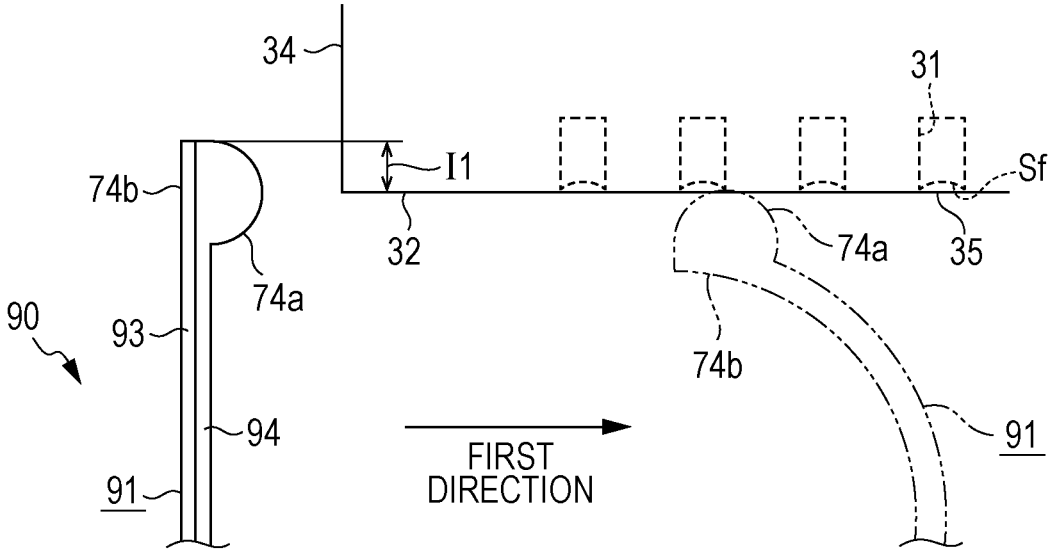
FIG. 5A is a view illustrating a first wiping operation of a wiping device of Embodiment 3 and FIG. 5B is a view illustrating a second wiping operation.

A wiping device 90 of Embodiment 3 includes a wiper 91 and the wiper support portion 75, as illustrated in FIG. 5A. The wiper 91 has both the first surface 74*a* and the second surface 74*b* which can wipe the nozzle forming surface 32. The wiper support portion 75 supports the wiper 91. In this case, the wiper 91 includes a first wiping portion 92 and a second wiping portion 93. The first wiping portion 92 includes the first surface 74*a* and is located on the first surface 74*a* side. The second wiping portion 93 includes the second surface 74*b* and is located on the second surface 74*b* side.

The hardness of the first wiping portion 92 is less than that of the second wiping portion 93. In other words, the elastic modulus of the first wiping portion 92 is less than that of the second wiping portion 93. Accordingly, it is possible to say that, when the second contact pressure is equal to or less than the first contact pressure, it is more difficult for the wiper 91 to enter the nozzles 31, during the second wiping operation in which the nozzle forming surface 32 is wiped by the second wiping portion 93 having high hardness, compared to the first wiping operation in which the nozzle forming surface 32 is wiped by the first wiping portion 92 having low hardness. The wiper 91 may be produced in such a manner that the first wiping portion 92 and the second wiping portion 93 having different hardness are separately formed, and then the first wiping portion 92 is bonded to the second wiping portion 93. Furthermore, when the wiper 91 is formed of rubber material, the wiper 91 may be integrally formed in a state where the rubber material on the first surface 74*a* side and the rubber material on the second surface 74*b* side have different compositions.

Next, the operation of the wiping device 90 of Embodiment 3 will be described.

Figure 5B:
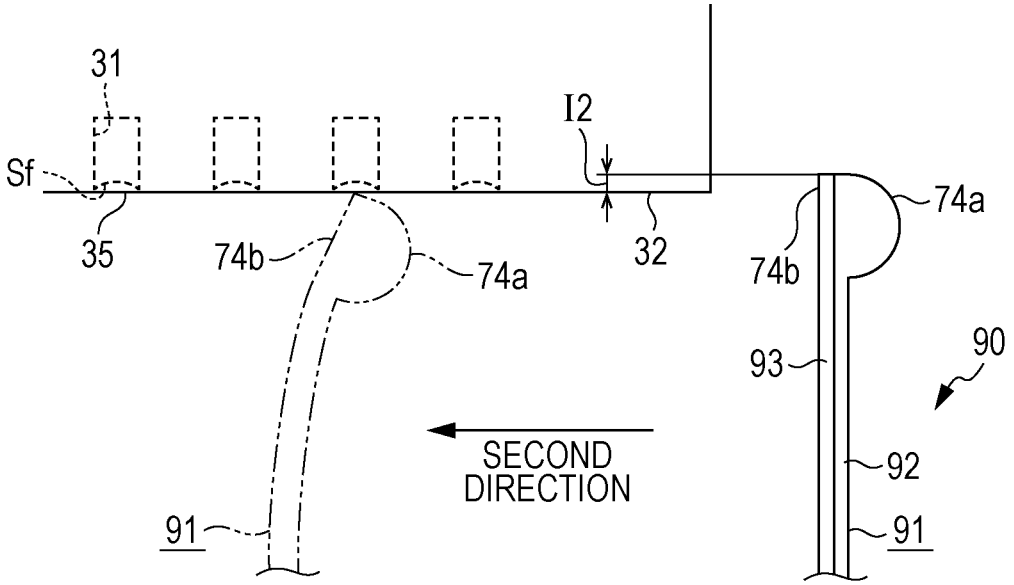

When the pressurized wiping is performed, the lifting mechanism 76 is driven and the wiping device 90 ascends to the position at which the wiping device 90 can wipe the nozzle forming surface 32, as illustrated in FIGS. 5A and 5B. Specifically, the amount of interference between the wiper 91 and the nozzle forming surface 32 is set to a first amount of interference I1. The pressure of the liquid in the nozzles 31 is pressurized by driving the pressurizing portion 60.

The first wiping operation in which the first surface 74*a* wipes the nozzle forming surface 32 is performed by the wiping device 90, in such a manner that the wiping device 90 causes the wiper 91, along with the wiper support portion 75, to move in the first direction. When the first wiping operation is finished, the lifting mechanism 76 is driven and the amount of interference between the wiper 91 and the nozzle forming surface 32 is changed to a second amount of interference I2 which is less than the first amount of interference I1, as illustrated in FIG. 5B. Then, the second wiping operation in which the second surface 74*b* wipes the nozzle forming surface 32 is performed by the wiping device 90, in such a manner that the wiping device 90 causes the wiper 91, along with the wiper support portion 75, to move in the second direction.

Accordingly, the amount of elastic displacement of the wiper 91 in the first wiping operation is greater than that in the second wiping operation, as illustrated in FIGS. 5A and 5B. Thus, compared to in the case of the first wiping operation, the amount of elastic displacement of the wiper 91 is small in the second wiping operation having the small amount of interference between the wiper 91 and the nozzle forming surface 32 is small. As a result, the restoring force of the wiper 91 is reduced in accordance with the amount of displacement. Accordingly, the contact force between the wiper 91 and the nozzle forming surface 32 is reduced, and thus the second contact pressure in the second wiping operation is less than the first contact pressure in the first wiping operation.

Therefore, even in a case where, during the first wiping operation, the first surface 74*a* comes into contact with the liquid in the nozzles 31 and the liquid leaks from the nozzles 31, when the second wiping operation having a small contact pressure with respect to the nozzle forming surface 32 is performed, the second surface 74*b* removes the liquid adhering to the nozzle forming surface 32, in a state where the second surface 74*b* is prevented from pushing air bubbles into the nozzles 31. Furthermore, in this embodiment, the hardness of the second wiping portion 93 is greater than that of the first wiping portion 92. Thus, when the second wiping operation is performed, it is difficult for the second surface 74*b* (the wiper 91) to be deformed and enter the nozzles 31. As a result, it is more difficult for the second surface 74*b* to push air bubbles.

Meanwhile, when the amounts of interference are set to be the same in both the first wiping operation and the second wiping operation, the contact area between the first surface 74*a* and the nozzle forming surface 32, during the first wiping operation, is likely to be greater than the contact area between the second surface 74*b* and the nozzle forming surface 32, during the second wiping operation. This results from a difference in hardness. Accordingly, in this embodiment, it is preferable that, for example, the amount of interference of the wiper 91 in the first wiping operation or the second wiping operation be set to the value in which the second contact pressure is less than the first contact pressure.

According to the embodiment described above, the following effects, in addition to the effects (1) to (3) of Embodiment 1, can be obtained.

(7) Since the amount of interference between the wiper 91 and the nozzle forming surface 32 is great in the first wiping operation, the amount of elastic displacement of the wiper 91 is likely to increase, and thus the first contact pressure is likely to increase due to the restoring force of the wiper 91 corresponding to the amount of displacement. In contrast, since the amount of interference between the wiper 91 and the nozzle forming surface 32 is small in the second wiping operation, the amount of elastic displacement of the wiper 91 is likely to be reduced, and thus the second contact pressure is likely to be reduced due to the restoring force of the wiper 91 corresponding to the amount of displacement. As a result, the second contact pressure can be set to be less than the first contact pressure, in such a manner that the amount of interference between the wiper 91 and the nozzle forming surface 32 is adjusted.

(8) When the second wiping operation is performed, the nozzle forming surface 32 is wiped by the second surface 74*b* having the hardness higher than that of the first surface 74*a*. Thus, when the second wiping operation is performed, the displacement of the second surface 74*b* is suppressed, and thus it is difficult for the second surface 74*b* to enter the nozzles 31. In other words, in the second wiping operation, the nozzle forming surface 32 can be wiped in a state where the second surface 74*b* is prevented from coming into contact with the liquid in the nozzles 31.

The embodiments described above may be modified as follows.

The liquid ejecting apparatus 11 may further include a controller which controls the wiping operation of the wiper 74 and a liquid leakage detection portion which detects whether liquid leaks from the nozzles 31, during the first wiping operation. In this case, it is preferable that, when the liquid leakage detection portion detects the leakage of liquid from the nozzles 31, the controller perform the second wiping operation. When the liquid ejecting head 33 has a configuration in which a diaphragm is oscillated by driving a piezoelectric element and the liquid is ejected from the nozzles 31, the leakage of liquid from the nozzles 31 may be detected in such a manner that the liquid leakage detection portion detects, for example, change in oscillation of the diaphragm in the first wiping operation. When the liquid leaks from the nozzles 31, the pressure of liquid in the supply tube 42 is reduced. Thus, the leakage of liquid from the nozzles 31 may be detected in such a manner that the liquid leakage detection portion detects the reduction in pressure.

When, during the first wiping operation, liquid does not leak from the nozzles 31, it is not necessary to perform the second wiping operation. In contrast, when, during the first wiping operation, liquid leaks from the nozzles 31, it is necessary to perform the second wiping operation. Accordingly, since it can be configured so that the second wiping operation is performed only when it is necessary to perform the second wiping operation, the time required for the maintenance of the liquid ejecting head 33 can be reduced.

The pressurizing portion 60 may have other configurations as long as these can ensure that the pressure of liquid in the nozzles 31 is equal to or greater than atmospheric pressure. When the liquid ejecting head 33 has a configuration in which a diaphragm is oscillated by driving a piezoelectric element and the liquid is ejected from the nozzles 31, the pressure of liquid in the nozzles 31 may be set to be equal to or greater than atmospheric pressure, in such a manner that a constant voltage is applied to the piezoelectric element. In this case, both the piezoelectric element and the diaphragm correspond to an example of the pressurizing portion 60.

The second surface 74*b* may have a convex-curved surface, in the second direction. In this case, it is preferable that the curvature of the convex-curved surface of the first surface 74*a* be greater than that of the second surface 74*b*.

In Embodiment 1 or Embodiment 2, the amount of interference between the wiper 74 and the nozzle forming surface 32 may be changed between the first wiping operation and the second wiping operation.

In Embodiment 2 or Embodiment 3, both the first surface 74*a* and the second surface 74*b* may have the same shape. Even in this case, the first contact pressure in the first wiping operation can be set to be greater than the second contact pressure in the second wiping operation. In other words, the wiper 74 or 91 may have a plate shape.

In Embodiment 2, the regulation portion 83 may regulate the amount (hereinafter, referred to also as a "first amount of pivoting") of pivoting of the pivoting member 81 in the second wiping operation, to be less than the amount (hereinafter, referred to also as a "second amount of pivoting) of pivoting of the pivoting member 81 in the first wiping operation. In other words, the regulation portion 83 does not regulate the amount of the pivoting of the pivoting member 81 in the first wiping operation to be "0 (zero)". Even in this case, since the second amount of pivoting is less than the first amount of pivoting, the amount of elastic displacement of the wiper 74 in the first wiping operation is greater than the amount of elastic displacement of the wiper 74 in the second wiping operation. As a result, the first contact pressure is set to be greater than the second contact pressure.

When the regulation portion 83 for regulating pivoting of the pivoting member 81 in the first wiping operation is set to a first regulation portion, Embodiment 2 may further include a second regulation portion for regulating pivoting of the pivoting member 81 in the second wiping operation. In this case, it is preferable that both the first regulation portion and the second regulation portion regulate pivoting of the pivoting member 81, in a state where the first amount of pivoting is set to be less than the second amount of pivoting.

In Embodiment 2, the elastic member 84 may not be provided.

In Embodiment 2, the regulation portion 83 may directly regulate pivoting of the wiper 74, without the intervention of the pivoting member 81. In this case, it is preferable that the elastic member 84 directly connect the wiper 74 and the wiper supporting portion 82, without the intervention of the pivoting member 81, and the wiper supporting portion 82 pivotally support the wiper 74. As a result, the effects of Embodiment 2 can be obtained without the pivoting member 81.

In Embodiment 2, the pivoting member 81 may be elastically deformable. In this case, it is preferable that the elastic modulus of the pivoting member 81 is greater than that of the wiper 74.

In Embodiment 3, both the first wiping portion 92 and the second wiping portion 93 may have the same hardness.

The lifting mechanism 76 may change the amount of interference of the wiper 74 or 91, in such a manner that the lifting mechanism 76 causes the liquid ejecting head 33 to ascend or descend.

The second surface 74*b* may not be a flat surface perpendicular to the second direction.

The wiper 74 or 91 may wipe the nozzle forming surface 32, in such a manner that the liquid ejecting head 33 moves relative to the wiping device 70, 80, or 90 in a fixed state.

The liquid ejecting apparatus 11 is not limited to a line printer. The liquid ejecting apparatus 11 may be a serial printer or a page printer.

The liquid ejecting apparatus 11 may be a liquid ejecting apparatus that ejects or discharges a liquid other than ink. Furthermore, the small amount of liquid discharged from the liquid ejecting apparatus includes granule forms, teardrop forms, and forms that pull trails in a string-like form therebehind. In addition, the liquid referred to here can be any material capable of being ejected by the liquid ejecting apparatus. For example, any matter can be used as long as the matter is in its liquid phase, including liquids having high or low viscosity, sol, gel water, other inorganic solvents, organic solvents, liquid solutions, liquid resins, and fluid states such as liquid metals (metallic melts). Furthermore, in addition to liquid as one phase of a matter, liquids in which the particles of a functional material composed of a solid matter such as pigments, metal particles, or the like are dissolved, dispersed, or mixed in a liquid carrier are included as well. Ink, a liquid crystal, or the like is exemplified as a representative example of a liquid in the embodiments described above.

In this case, the ink includes a general water-based ink and oil-based ink, aside from various liquid compositions of a gel ink, a hot melt ink or the like. A liquid ejecting apparatus which ejects liquid containing material such as an electrode material or a coloring material in a dispersed or dissolved state, which is used for manufacturing a liquid crystal display, an electroluminescence (EL) display, a surface-emitting display, a color filter or the like is exemplified as a specific example of the liquid ejecting apparatus. In addition, the liquid ejecting apparatus may be a liquid ejecting apparatus for ejecting a living organic material used for manufacturing a biochip, a liquid ejecting apparatus for ejecting a liquid as a sample used as a precision pipette, a printing equipment, a micro dispenser or the like. Further, the liquid ejecting apparatus may be a liquid ejecting apparatus for precisely ejecting lubricant to a precision machine such as a watch or a camera, or a liquid ejecting apparatus that ejects on a substrate a transparent resin liquid such as an ultraviolet curing resin in order to form a minute hemispherical lens (an optical lens) used in an optical communication element or the like. In addition, the liquid ejecting apparatus may be a liquid ejecting apparatus that ejects an etching liquid such as acid or alkali to etch a substrate or the like.

What is claimed is:

1. A liquid ejecting apparatus comprising:

a liquid ejecting head which ejects liquid supplied from a supply source and has a nozzle forming surface having nozzles formed therein;

a pressurizing portion which is located further to the supply source side than the nozzles and can pressurize the liquid supplied to the nozzles; and a wiper which has a convex-curved surface and a flat surface capable of wiping the nozzle forming surface and is elastically deformable, wherein a first wiping operation in which the convex-curved surface wipes the nozzle forming surface is performed in a state where the pressurizing portion is driven and a pressure of the liquid in the nozzles is set to be equal to or greater than atmospheric pressure, and a second wiping operation in which the flat surface wipes the nozzle forming surface wiped by the convex-curved surface during the first wiping operation is performed in a state where the flat surface is in contact with the nozzle forming surface, wherein a contact pressure between the flat surface and the nozzle forming surface is less than a contact pressure between the convex-curved surface and the nozzle forming surface.

2. The liquid ejecting apparatus according to claim 1, further comprising:

a controller which controls a wiping operation of the wiper; and a liquid leakage detection portion which detects whether liquid leaks from the nozzles, during the first wiping operation, wherein, when the liquid leakage detection portion detects leakage of the liquid from the nozzles, the controller performs the second wiping operation.

3. The liquid ejecting apparatus according to claim 1, wherein a contact length of the flat surface with the nozzle forming surface in a movement direction of the wiper in the first wiping operation is shorter than a contact length of the second surface with the nozzle forming surface in a movement direction of the wiper in the second wiping operation.

4. The liquid ejecting apparatus according to claim 1, wherein the first wiping operation is performed in a state where the liquid does not go out from the nozzles.

5. The liquid ejecting apparatus according to claim 1, wherein the first wiping operation and the second wiping operation are performed in a state where an amount of Interference between the wiper and the nozzle forming surface is same.

* * * * *